US010027042B2

(12) United States Patent
Turner

(10) Patent No.: US 10,027,042 B2
(45) Date of Patent: Jul. 17, 2018

(54) SWAGE HIGH VOLTAGE CABLE TERMINAL

(71) Applicant: AFL TELECOMMUNICATIONS LLC, Duncan, SC (US)

(72) Inventor: Kelvin Turner, Williamston, SC (US)

(73) Assignee: AFL Telecommunications LLC, Duncan, SC (US)

( * ) Notice: Subject to any disclaimer, the term of this patent is extended or adjusted under 35 U.S.C. 154(b) by 0 days.

(21) Appl. No.: 15/522,346

(22) PCT Filed: Oct. 28, 2015

(86) PCT No.: PCT/US2015/057768

§ 371 (c)(1),
(2) Date: Apr. 27, 2017

(87) PCT Pub. No.: WO2016/069721

PCT Pub. Date: May 6, 2016

(65) Prior Publication Data

US 2017/0338573 A1 Nov. 23, 2017

Related U.S. Application Data

(60) Provisional application No. 62/069,689, filed on Oct. 28, 2014.

(51) Int. Cl.

| | |
|---|---|
| ***H01R 4/02*** | (2006.01) |
| ***H01R 11/11*** | (2006.01) |
| ***H01R 43/16*** | (2006.01) |
| ***H01R 4/18*** | (2006.01) |

(52) U.S. Cl.
CPC ..... *H01R 11/11* (2013.01); *H01R 4/183* (2013.01); *H01R 43/16* (2013.01)

(58) Field of Classification Search
CPC ..... H01R 4/20; H01R 11/22; H01R 4/723
USPC ..... 439/874, 730, 932, 859
See application file for complete search history.

(56) References Cited

U.S. PATENT DOCUMENTS

| | | | | |
|---|---|---|---|---|
| 2,957,226 | A | 10/1960 | Dibner | |
| 7,887,380 | B2 * | 2/2011 | Ross | H01R 11/12 29/882 |
| 8,519,267 | B2 * | 8/2013 | Peters | H01R 4/203 174/122 C |
| 2006/0248938 | A1 | 11/2006 | Lowe | |
| 2007/0093120 | A1 | 4/2007 | Hardy et al. | |
| 2014/0065879 | A1 | 3/2014 | Daughtry, Jr. et al. | |

FOREIGN PATENT DOCUMENTS

WO WO2010/042579 A2 4/2010

OTHER PUBLICATIONS

AFL Telecommunications LLC; International Patent Application No. PCT/US2015/057768; International Search Report; dated Jan. 27, 2016; (1 page).

* cited by examiner

*Primary Examiner* — Phuong Chi T Nguyen
(74) *Attorney, Agent, or Firm* — Dority & Manning, P.A.

(57) ABSTRACT

A terminal has a barrel with a cavity; a pad, wherein the pad includes a substantially flat part; and a connecting part between the barrel and the pad, wherein the terminal is a single component, and the pad and the connecting part are forged. A method for fabricating a terminal involves forging wherein the terminal is a single component.

20 Claims, 7 Drawing Sheets

SWAGE HIGH VOLTAGE CABLE TERMINAL

CROSS-REFERENCE TO RELATED APPLICATION

This application is based upon and claims the benefit of priority from U.S. Provisional Patent Application No. 62/069,689, filed Oct. 28, 2014 in the United States Patent and Trademark Office, and as a U.S. national stage filing of International Application No. PCT/US2015/057768 having an international filing date of Oct. 28, 2015, the disclosures of both of which are incorporated by reference herein in their entireties.

BACKGROUND

1. Technological Field

The present invention relates to cable terminals.

2. Description of Related Art

The current industry standard for high voltage cable terminals, for example systems rated at 230 kV or higher, that can be swaged onto a cable is to weld a cable barrel to a pad which may or may not contain a corona ring. In some cases, a corona ring may be required when a high voltage cable system rated at 500 kV or higher rated is used. FIG. 7 is an example of a welded product including a barrel 710, pad 720, and welded part 740 with a corona ring 750. FIG. 8 is an example of a welded product including a barrel 810, pad 820, and welded part 840 without a corona ring.

A method employing welding incurs considerable manufacturing cost. For example, to construct a cable terminal, the pad must first be manufactured either by casting and subsequent finishing machining, or by extensively machining a semi-finished product. The cable barrel also must be fabricated by machining. After both parts are machined and the appropriate parts are heat treated, the separate pad and barrel parts will be welded together. The welding step adds time and cost to the manufacturing process. It also risks the possibility for error during the weld, which can result in defects that are only visible by X-Ray.

In typical high voltage cable terminals, the terminal must provide good mechanical strength and conductivity. However, an improved terminal having excellent mechanical and electrical properties, as well as being low in manufacturing cost is desired. Furthermore, a terminal not requiring a corona ring may be beneficial.

SUMMARY

Exemplary embodiments of the present disclosure overcome the above disadvantages and other disadvantages not described above. Also, exemplary embodiments of the present disclosure are not required to overcome the disadvantages described above, and an exemplary embodiment of the present disclosure may not overcome any of the problems described above.

Provided is a terminal apparatus comprising a barrel having a cavity, a pad with a substantially flat part, and a connecting part between the barrel and the pad, wherein the terminal is a single component and the pad and the connecting part are forged.

In an exemplary aspect, the terminal may further comprise at least one hole formed in the pad.

In an exemplary aspect, the terminal may further comprise a swage portion provided on the barrel.

In an exemplary aspect, the terminal may be further configured such that the connecting part comprises fillet parts.

In an exemplary aspect, the terminal may further comprise a second barrel comprising a second cavity, wherein the pad is provided between the barrel and the second barrel.

In an exemplary aspect, the terminal may be further configured such that a longitudinal axis of the cavity of the barrel is offset from a top surface of the pad by a predetermined distance.

In an exemplary aspect, the terminal may be further configured such that a longitudinal axis of the cavity of the barrel is formed at a predetermined angle with respect to a plane of the flat part of the pad, the predetermined angle being in a range of greater than 0 and less than 180 degrees.

In an exemplary aspect, the terminal may be further configured such that a longitudinal axis of the cavity of the barrel is coplanar with an equatorial plane of the pad.

In an exemplary aspect, the terminal may be further configured such that the connecting part is symmetric about a plane perpendicular to the flat part.

In an exemplary aspect, the terminal may be further configured such that the terminal is symmetric about a plane perpendicular to the flat part.

In an exemplary aspect, the terminal may further comprise a hole extending from an inner surface of the cavity to the outer circumferential surface of the barrel.

According to another exemplary aspect, there is provided a method of manufacturing a terminal comprising heating one end of a workpiece, wherein the workpiece comprises a cylindrical barrel comprising a cavity at a second end opposite the one end, and forming a flat pad in the one end of the workpiece by forging. The terminal may be a single component.

In an exemplary aspect, the method may further comprise forming the cavity in the barrel.

In an exemplary aspect, the method further comprise boring the one end of the workpiece to remove material from the workpiece prior to forging.

In an exemplary aspect, the workpiece in the method may be a cable coupler comprising the barrel at the second end and a second barrel at the one end

BRIEF DESCRIPTION OF THE DRAWINGS

The above and other aspects of the present disclosure will become more apparent from the following description of exemplary embodiments, taken in conjunction with the accompanying drawings of which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Cable terminals of exemplary embodiments set forth herein relate to connectors useful in connecting cables for electric power transmission in electrical substations and overhead transmission lines. A terminal can be connected to a cable to terminate the cable by swaging a cylindrical barrel around the cable. Common cables used in electric power transmission include aluminum conductor steel reinforced (ACSR) and All Aluminum Conductor (AAC) cables. These cables typically comprise a plurality of layers of strands, with or without a central core which provides structural strength. The barrel is typically connected to a flat pad which has holes for connecting the pad to various structures by means of bolting, for example. An exemplary pad is formed to a NEMA standard. The pad should have good electrical properties to sustain a predetermined current load, and must have sufficient mechanical strength to support heavy cables which may be under high tension.

Figure 1:
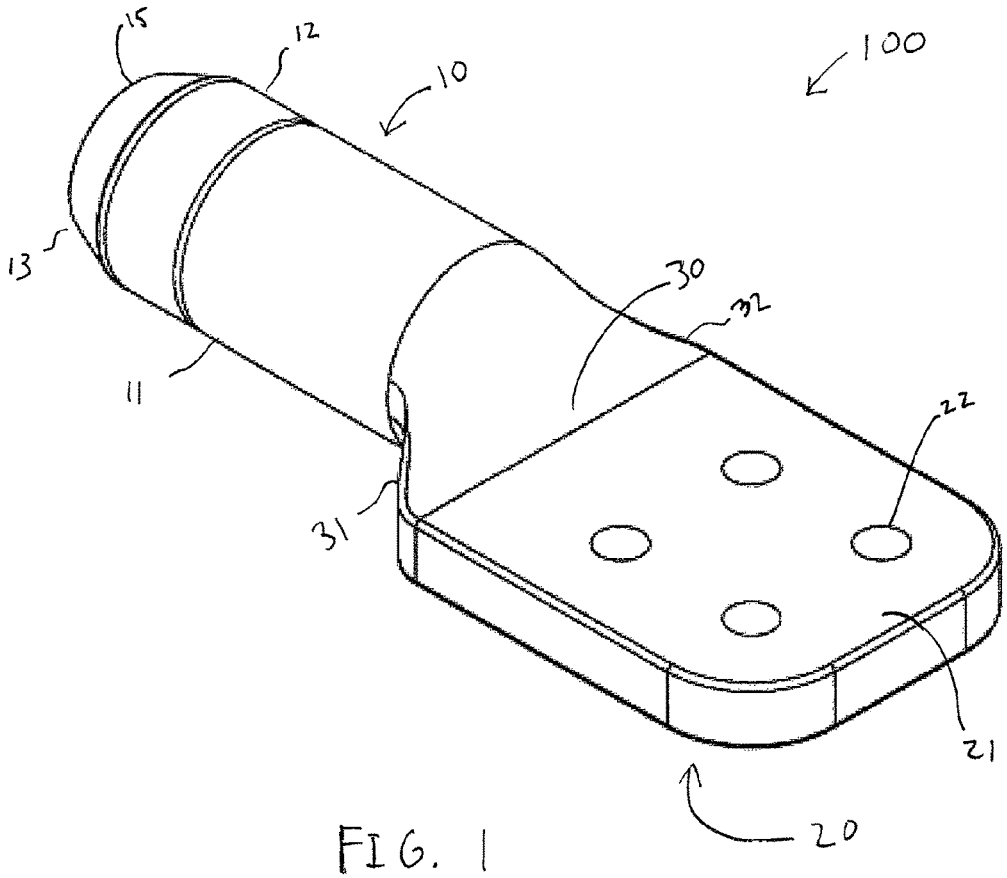
FIG. 1 is an isometric view of a terminal according to a first embodiment.
Figure 2:
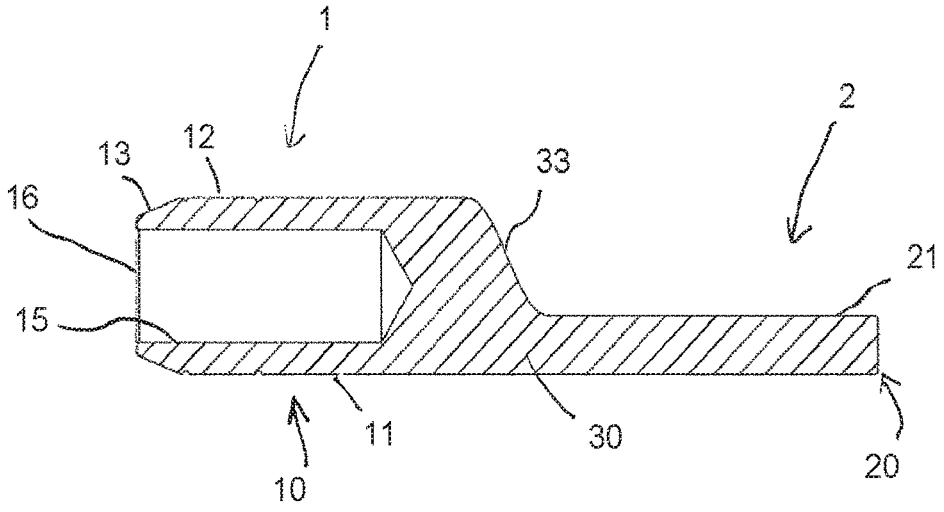
FIG. 2 is a cross sectional view of the terminal according to the first embodiment.

FIG. 1 illustrates a terminal 100 according to a first embodiment of the present disclosure. A barrel 10 for use in a swage terminal comprises a cylindrical body 11 with a cavity 15 configured to be compressed with a swaging tool around a cable to grip the outer layer of cable strands. Swaging causes the outer layer of strands to compress the inner layers, including the cable core, thus extending the gripping action to the core and enhancing the tension carrying capacity of the connection. As shown in FIG. 2, the barrel 10 may have a substantially cylindrical body 11 and a substantially cylindrical inner cavity 15 with one opening 16. In some embodiments, the cavity 15 may be formed with stepped portions having progressively decreasing inner diameters from the opening 16 of the cavity 15 toward an inner part of the barrel 10.

A pad 20 to which the barrel 10 is attached should be substantially planar and flat to accommodate mounting to standard structures using common fasteners, for example nuts and bolts. The pad 20 has a substantially flat part 21. Top and bottom surfaces of a pad with satisfactory flatness can be obtained by machine finishing, for example.

The terminal 100 according to the first embodiment may be forged from a single piece of material. The barrel 10 may be formed first by machining to define a portion for accommodating an end of a cable configured to be joined by swaging. Thereafter, the pad 20 may be formed by forging. Pad holes 22 and radii, for example corner radius R shown in FIG. 3, can be added after the forging process. The terminal 100 resulting from the forging process comprises a connecting part 30 between the barrel 10 and the pad 20 which is forged and integral with both the pad 20 and the barrel 10.

As a precursor to the forging process, a material may be selected from ingot, billet, bar, or preform. For example, a precursor material having a substantially cylindrical shape, such as rod preform, may be cut to a predetermined length and used. At a first end 1 of the rod, machining can be carried out to define the barrel 10. For instance, the cavity 15 having a specified inner diameter and depth can be formed by a lathe. The barrel 10 itself comprising the body portion 11 can be formed to a substantially cylindrical shape with a specified outer diameter. The barrel 10 may have a tapered portion 13. Other external features, for example, markings and notches to indicate a swage portion 12 can also be added by a lathe or press. Furthermore, a hole 201, similar to that shown in FIGS. 4 and 5, can be formed extending from an inner surface of the cavity 15 to the outer circumferential surface of the barrel 10. The hole 201 may be useful for injecting a filler compound to enhance connection when the terminal is later joined with a cable.

Next, a second end 2 of the rod, opposite the first end 1, may be processed to define the pad 20 by forging. Forging is a process using presses or hammers to apply compressive forces to deform a metal, and shall not be described in detail here. Briefly, in an exemplary forging process, the workpiece is annealed prior to forging, then positioned between dies in a forge. In this case, open die forging, in which the dies do not completely enclose the workpiece, can be used to press the second end 2 to a substantially flat shape while maintaining the shape of the barrel 10 at the first end 1, which is held outside the forge. Simple flat dies may be used in the forge to obtain a plate shape which will then form the planar, substantially flat part 21 of the pad 20. The forging process may comprise one press stroke, or several press strokes at the same or differing force.

Figure 3:
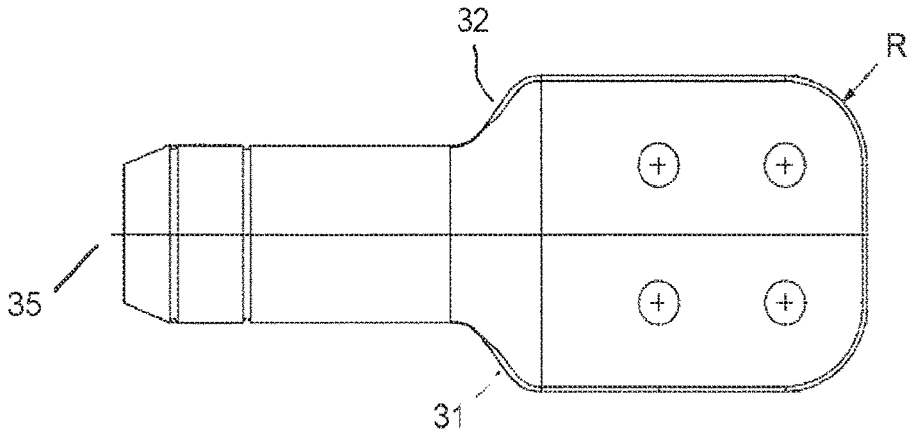
FIG. 3 is a top view of the terminal according to the first embodiment.

By pressing a metal material in a forge, dies contacting the second end 2 can shape the pad 20 to be flat, while the connecting part 30, which is partially outside the space sandwiched by the dies, is formed with gentle contours, for example, fillet parts 31, 32, and 33 are formed. Furthermore, the terminal 100 can be formed with symmetry in a medial plane. That is, the terminal 100 is symmetric when viewed in a top view with respect to a longitudinal axis 35 of the cavity 15 of the barrel 10, as shown in FIG. 3; or in other words, symmetric about a plane perpendicular to the flat part 21, and the longitudinal axis 35 intersecting the plane. Symmetry may be easier to achieve when a precursor material having symmetry in a medial plane is used, such as a cylindrical rod or a rectangular bar. The pad thickness can be controlled by drilling out the center of the workpiece at the second end 2 prior to forging to reduce the volume of material which will be pressed by the forge.

To obtain the final desired shape, post processing including trimming and finishing machining may be carried out. For example, sides of the pad 20 may be cut to form a substantially rectangular shape. Further post processing such as finish pressing may be carried out to bring the pad 20 to a specified level of flatness on both top and bottom sides. Top and bottom surfaces of the pad may also be flattened by milling. Furthermore, an outer radius R can be applied to corners by machining. Holes 22 having a specified diameter can be formed by drilling.

Although a process has been described above in which machining the barrel 10 precedes forging the pad 20, these processes could be reversed.

Advantages of employing a forging process will be apparent to those having ordinary skill in the art. For example, forging yields products having a high strength to weight ratio, improved metallurgical microstructure, improved anisotropic properties due to directional grain flow (and thus the ability to orient the grain to increase strength in a particular direction), reduced or eliminated porosity/voids which may occur in cast parts, and better fatigue resistance. Due to this, superior mechanical properties can be obtained compared to cast components. Furthermore, it should be noted that the forging process described above eliminates the need for welding and machining steps to join and finish separate barrel and pad components. This will reduce the cost, time to manufacture, and error in the process of fabricating a terminal. Error in the welding process can arise due to the type of weld, type of joint, position of the weld, material of the weld, material of the base metal, and the skill of the welder, for example.

It shall also be noted that welding separate materials together by use of fillet welding, for example, may reduce the strength of the base materials, especially in the heat affected zone. Additionally, in a terminal fabricated by welding, stress concentration may occur near a portion where the barrel and the pad are joined, due to unfavorable geometry.

In contrast, due to the use of forging, fillet parts are naturally generated due to the flow of material during the forging process. Fillet parts 31, 32 and 33 are shown in FIGS. 1-3, for example.

A process comprising open die forging has been described above, however, it should be noted that closed die forging could also be employed. For example, dies having a shape conforming to the final desired product could be used. Alternatively, semi-closed dies could be used in which the dies substantially define the desired shape of the pad 20 while providing an opening for the barrel 10 of the first end 1 to emerge.

Figure 9:
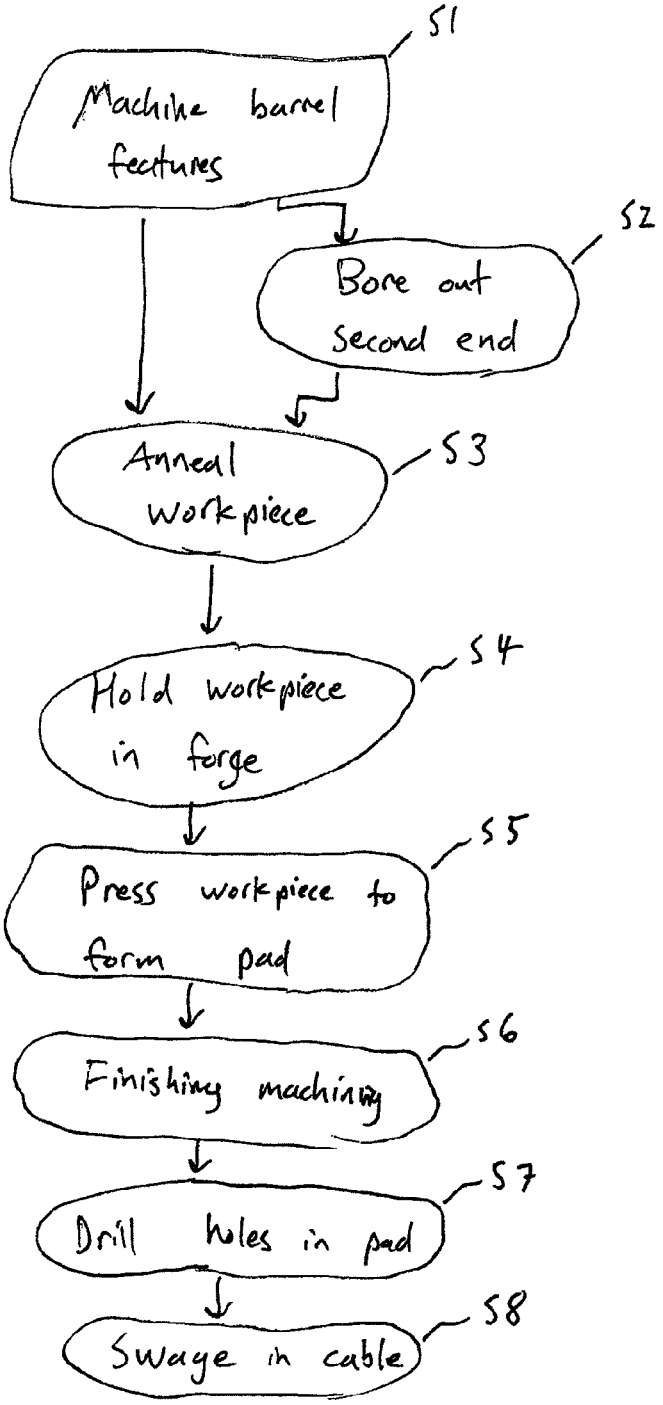
FIG. 9 is a flow chart representing a method for manufacturing a terminal according to an exemplary embodiment of the application.

A method of manufacturing a terminal will now be described in further detail. An exemplary procedure is outlined by the flowchart of FIG. 9.

In a first step S1, barrel features are machined at a first end of a workpiece. For example, an inner cavity is formed to a predetermined inner diameter and depth. A hole for filling compound is also drilled from the exterior of the barrel.

Optionally, in step S2, a second end, opposite to the first end, is bored out to remove material.

In step S3, the workpiece is brought to an elevated temperature and annealed, for example, by a furnace.

In step S4, the workpiece is held in a forge, centered between two flat dies.

In step S5, the forge presses the workpiece at the second end to form a pad.

In step S6, finishing machining is carried out to obtain the final desired shape. For example, corners and edges of the pad are rounded.

In step S7, holes are drilled.

As an example of using the fabricated terminal, in step S8, one end of a conductor cable is terminated in the terminal by swaging.

A cable can be attached to the terminal by swaging using, for example, a rotary swage machine or a swage press powered by a hydraulic pump. In an exemplary swaging procedure, a cable comprising a plurality of strands (not shown) is inserted into the opening of the cavity of the barrel, such as that shown in FIG. 2. Then, the swage portion 12 of the barrel is swaged to secure the terminal to the cable. Swaging may be performed at one location on the length of the barrel, at several locations along the length of the barrel, or at several overlapping locations on the barrel.

Figure 7:
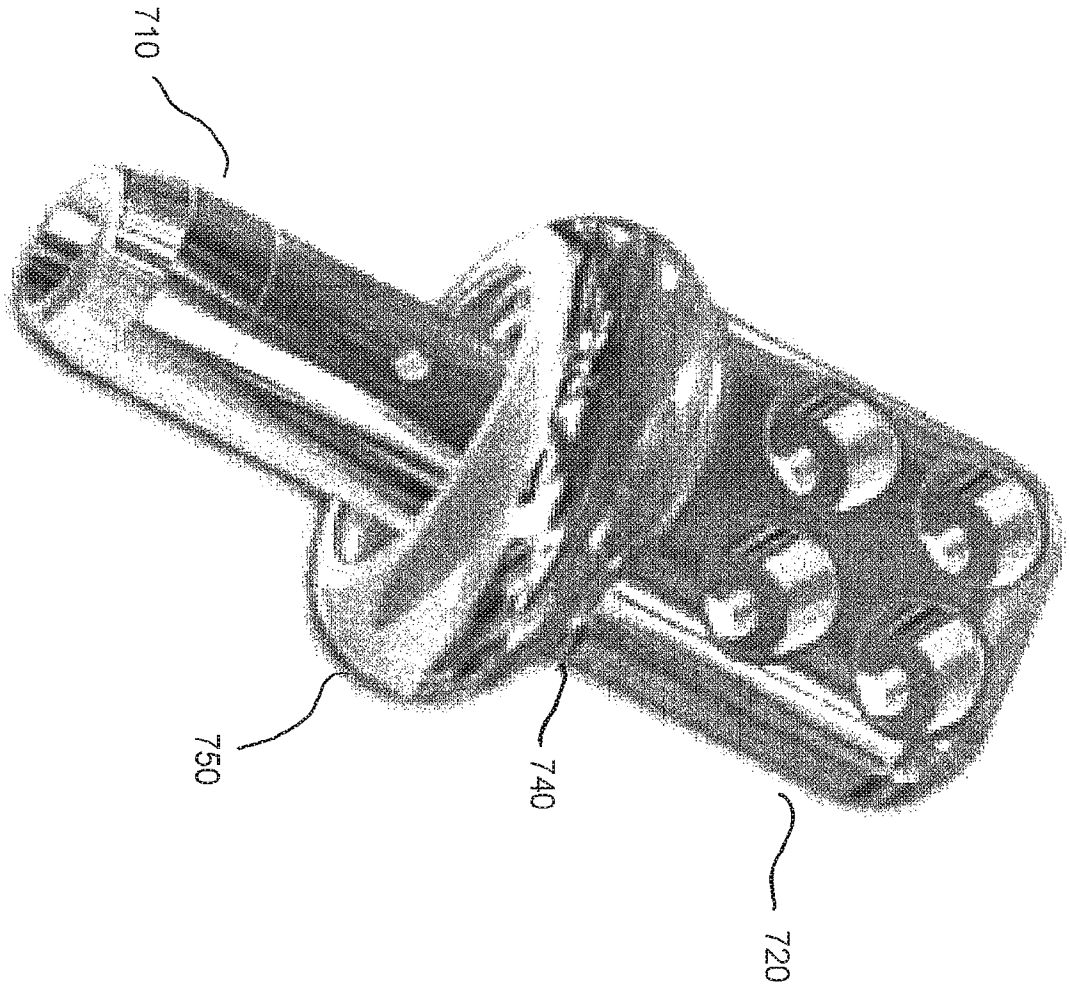
FIG. 7 shows a welded product with a corona ring.
Figure 8:
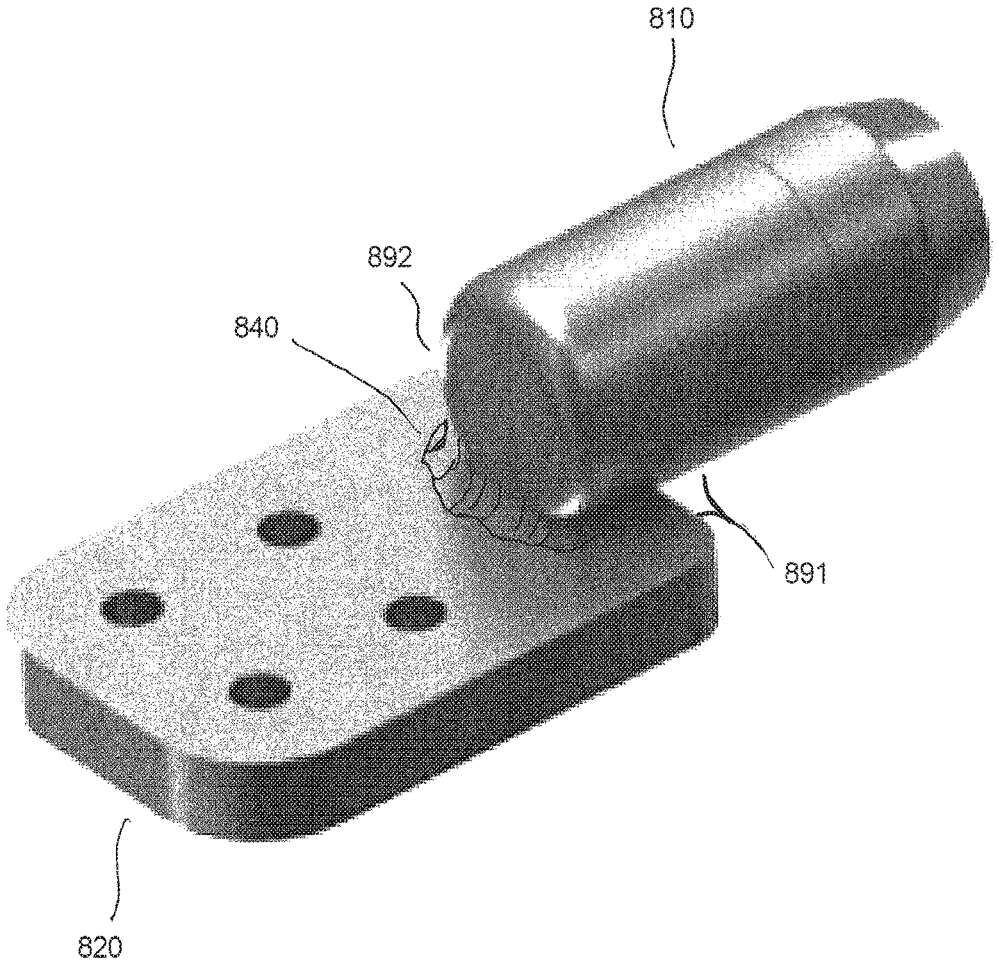
FIG. 8 shows a welded product without a corona ring.

A terminal 100 according to the first embodiment may be corona free after forging. This is due to the shape of the forged product having gentle fillets and curved features connecting the barrel to the pad. Electric field in a conductor is greatest where curvature is the sharpest, and therefore, corona discharge tends to occur first at sharp points. In some terminals, corona rings may need to be attached to distribute the electric field gradient arising from the high voltage electrical equipment. The terminal shown in FIG. 8, for example, has sharp corners, for example at 891 and 892, where electric field at the surface of the conductive material may be concentrated. Thus, in high voltage applications, a corona ring, such as that shown in FIG. 7, must be installed to prevent corona formation at sharp edges or corners. A terminal according to the first embodiment, however, eliminates this need.

Nevertheless, in some very high voltage applications, for example higher than 500 kV, it may be desirable to attach a corona ring to a terminal according to the first embodiment as an additional precaution.

Although a terminal comprising a barrel and a pad has been described above, it should be clear to one having ordinary skill in the art that a variety of shapes and other variations can also be obtained with some modification. For example, in another exemplary embodiment, an angled terminal can be formed comprising a barrel with a longitudinal axis of the cavity formed at a predetermined angle with respect to the plane of the pad, such as 45 degrees. An angled terminal may be formed by holding the first end comprising the barrel portion of the workpiece at an angle during the forging process. Alternatively, after forging is carried out, the first end can be bent to a predetermined angle while the second end is held in a brace, or vice versa.

Similarly, a 90-degree terminal can be formed, wherein a longitudinal axis of the cavity is perpendicular to the plane of the pad. A 90-degree terminal may be formed by first holding the first end of the workpiece and gradually upturning the first end during forging while the second end is being pressed.

In a similar manner, a terminal can be formed with a longitudinal axis of the cavity is angled to the left or right, when viewed in a top view such as that shown in FIG. 3.

Furthermore, a terminal can be formed comprising a barrel having a longitudinal axis of the cavity offset by a predetermined distance with respect to a top or a bottom surface of the pad. In an exemplary embodiment, an offset terminal is formed by placing the workpiece in the forge and holding the first end so that an outer surface of the barrel is in contact with the lower die of the forge. The lower die may thus be wider than the top die. In this manner, a terminal such as that of FIGS. 1-3 can be formed, in which the bottom of the outer surface of the barrel is level with the bottom surface of the pad.

In another exemplary embodiment, a center-formed terminal can be formed wherein the longitudinal axis is in line with the equatorial plane of the pad, that is, a terminal is formed having symmetry in a thickness direction of the pad. In other words, a longitudinal axis of the cavity of the barrel is coplanar with an equatorial plane of the pad.

Additionally, a variety of configurations having different numbers and sizes of holes formed in the pad is possible. For example, 2-hole pads, 4-hole pads, and 6-hole pads may be formed.

Figure 4:
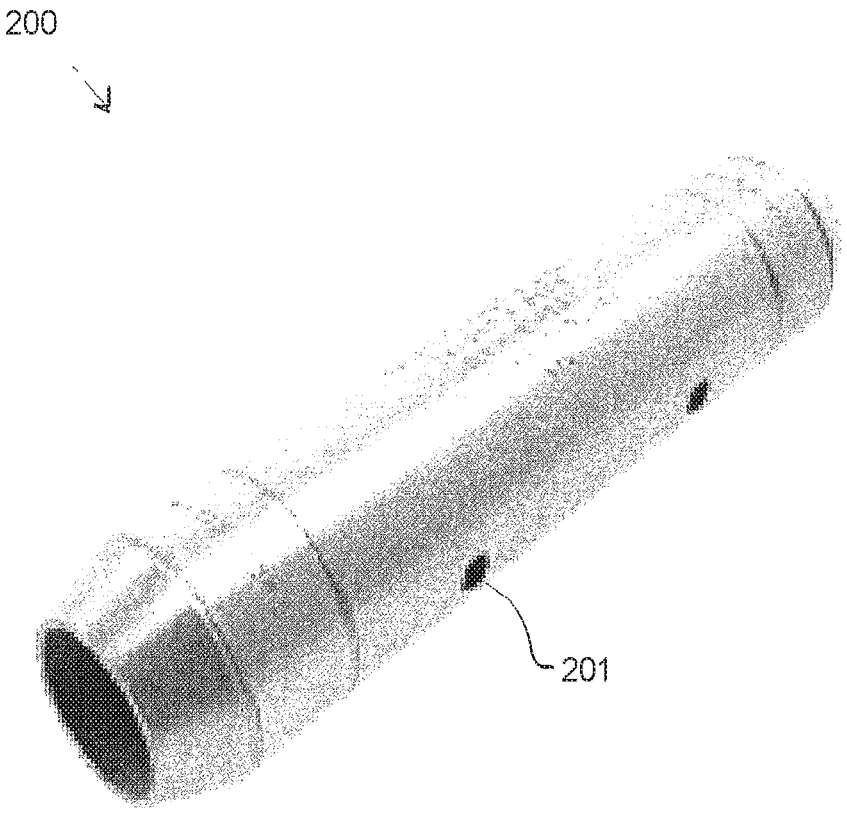
FIG. 4 is a perspective view of a cable coupler used in an embodiment of the present disclosure.
Figure 5:
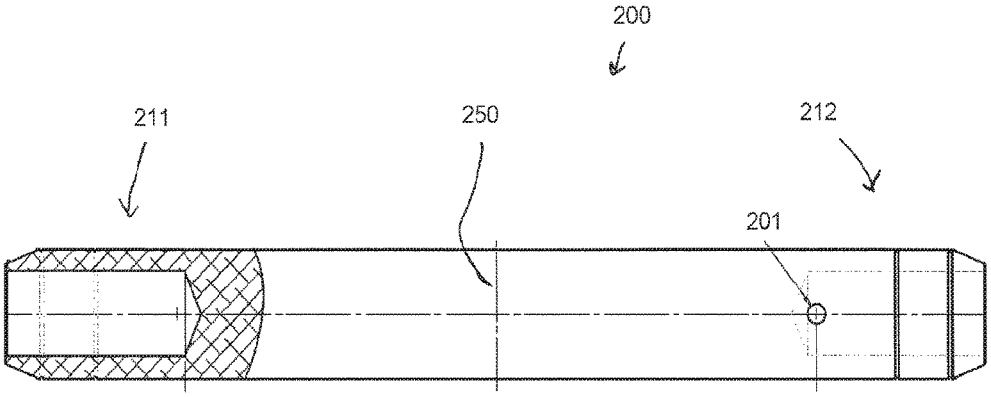
FIG. 5 is cross sectional view of the cable coupler used in an embodiment.
Figure 6:
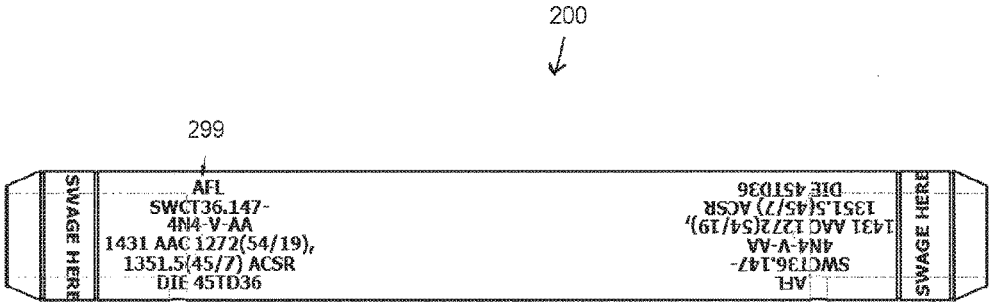
FIG. 6 is a top view of the cable coupler used in an embodiment.

In the first embodiment, a terminal may be formed from a generic workpiece, such as an intermediate casting including ingots, billets, slabs, and bars. However, in a second embodiment, a terminal may be formed from an existing cable coupler. FIGS. 4-6 show a swage cable coupler 200, which is a component designed to connect two cables end-to-end by swaging. The cable coupler may be formed by predetermined specifications for a certain type of cable and voltage rating. As shown in FIG. 6, the cable coupler may comprise indicia 299.

In the second embodiment, a first end 211 of the cable coupler is designated as the barrel to be swaged to a cable, and a second end 212 is designated to be formed into the pad by forging. The forging process, as discussed above with respect to the first embodiment, may be carried out to flatten the second end 212 of the cable coupler, thereby forming the pad. As in the first embodiment, the thickness of the pad may be controlled by additionally boring out material at the second end 212, for example by forming a hole larger in depth or diameter than the existing cavity at the second end 212.

In a third embodiment, a terminal comprising a pad with multiple barrels can be obtained. In the third embodiment, a precursor material may be a cable coupler or an intermediate casting. Forging is carried out such that only a center part of the precursor, for example, center part 250, is pressed to form the tab. The resulting product has two barrels at opposite ends and a flat pad at the center part.

It should be noted that the alternative embodiments mentioned above are not mutually exclusive, and may be combined with one another. For example, a terminal according to the third embodiment may be modified to have angled barrels.

Exemplary materials used in the exemplary embodiments mentioned above may be aluminum or aluminum alloy. Since typical conductor cables are made of aluminum, it may be desirable that all materials in a conductive line be of the same or similar materials so that they have a similar coefficient of thermal expansion. For example, substation accessories such as connectors and terminals may be designed with large contact area and appropriate clamping force to give long life and trouble free operation. Such accessories should be able to withstand and maintain high contact pressure during repeated heating and cooling cycles.

Although the exemplary embodiments discussed above are useful in the field of electric power transmission, a terminal consistent with the present disclosure need not necessarily be used with an electrical conductor cable. For example, a terminal could be used to connect a wire rope with swaging. Such wire ropes may be used to support structures, such as in suspension bridges and aerial tramways, or other structural ropes such as guy wires. Swaging may be a useful method to install wire ropes in terminals and other connectors with high strength and without voids.

What is claimed is:

1. A terminal comprising:
a barrel comprising a cavity;
a pad, wherein the pad comprises a substantially flat part; and
a connecting part between the barrel and the pad,
wherein the terminal is a single component, and the pad and the connecting part are forged using a forging process which comprises first annealing and then subsequently compressing a single piece of material.

2. The terminal of claim 1, further comprising
at least one hole formed in the pad.

3. The terminal of claim 1, further comprising
a swage portion provided on the barrel.

4. The terminal of claim 1, wherein
the connecting part comprises fillet parts.

5. The terminal of claim 1, further comprising
a second barrel comprising a second cavity, wherein the pad is provided between the barrel and the second barrel.

6. The terminal of claim 1, wherein
a longitudinal axis of the cavity of the barrel is offset from a top surface of the pad by a predetermined distance.

7. The terminal of claim 1, wherein
a longitudinal axis of the cavity of the barrel is formed at a predetermined angle with respect to a plane of the flat part of the pad, the predetermined angle being in a range of greater than 0 and less than 180 degrees.

8. The terminal of claim 1, wherein
a longitudinal axis of the cavity of the barrel is coplanar with an equatorial plane of the pad.

9. The terminal of claim 1, wherein
the connecting part is symmetric about a plane perpendicular to the flat part.

10. The terminal of claim 1, wherein
the terminal is symmetric about a plane perpendicular to the flat part.

11. The terminal of claim 1, further comprising
a hole extending from an inner surface of the cavity to the outer circumferential surface of the barrel.

12. The terminal of claim 1, wherein the terminal is corona free.

13. The terminal of claim 1, wherein the entire terminal is formed from aluminum or an aluminum alloy.

14. The terminal of claim 1, wherein distal edges of the pad are radiused.

15. A forging method of manufacturing a terminal, the method comprising:
heating one end of a workpiece to anneal the workpiece, wherein the workpiece comprises a cylindrical barrel comprising a cavity at a second end opposite the one end;
after heating the one end of the workpiece, using compressing forces to form a flat pad in the one end of the workpiece,
wherein the resulting forged terminal is a single component comprising a barrel comprising a cavity, a pad, wherein the pad comprises a substantially flat part, and a connecting part between the barrel and the pad.

16. The method of claim 15, further comprising
forming the cavity in the barrel.

17. The method of claim 15, further comprising
boring the one end of the workpiece to remove material from the workpiece prior to forging.

18. The method of claim 15, wherein
the workpiece is a cable coupler comprising the barrel at the second end and a second barrel at the one end.

19. The method of claim 15, wherein the terminal is corona free.

20. The method of claim 15, wherein the entire terminal is formed from aluminum or an aluminum alloy.

* * * * *